United States Patent [19]

Ziemba

[11] 4,095,529

[45] Jun. 20, 1978

[54] SETTING RING STOP

[75] Inventor: Richard Thomas Ziemba, Burlington, Vt.

[73] Assignee: General Electric Company, Burlington, Vt.

[21] Appl. No.: 769,760

[22] Filed: Feb. 17, 1977

[51] Int. Cl.[2] ..... F42C 17/00

[52] U.S. Cl. ..... 102/200; 102/276

[58] Field of Search ..... 102/70.2 R, 70.2 P, 102/82–84, 71; 89/6

[56] References Cited

U.S. PATENT DOCUMENTS

| | | | |
|---|---|---|---|
| 2,070,788 | 2/1937 | Girard | 102/84 |
| 2,270,534 | 1/1942 | Kunz | 102/83 |
| 2,939,394 | 6/1960 | LeRoy | 102/83 |
| 2,949,856 | 8/1960 | Mantel | 102/71 |
| 3,489,090 | 1/1970 | Simmen | 102/84 |
| 3,844,217 | 10/1974 | Ziemba | 102/70.2 R |

*Primary Examiner*—Charles T. Jordan

*Attorney, Agent, or Firm*—Bailin L. Kuch

[57] ABSTRACT

A mechanical stop for precluding the rotation of a setting ring beyond predetermined limits of a plurality of turns in the clockwise and counter-clockwise directions. The setting ring is adapted to drive the tape of a tape reader in the range setting mechanism of an electronic fuze for ordnance.

4 Claims, 3 Drawing Figures

SETTING RING STOP

BACKGROUND OF THE INVENTION

1. Field of Art

This invention relates to a stop for precluding the rotation of a setting ring beyond predetermined limits of a plurality of turns in the clockwise and counter-clockwise directions. This invention is particularly adapted for use in an electronic fuze for ordnance.

2. Prior Art

The use of setting rings to set an ordnance fuze to a predetermined range is now conventional, and is shown for example in my U.S. Pat. No. 3,844,217 filed Sept. 28, 1972, by R. Simmen in U.S. Pat. No. 3,489,090 filed Dec. 11, 1967, by H. M. Groff in U.S. Pat. No. 1,312,112, filed July 6, 1918, and in Technical Report 4624, "Beehive Electronic Time Fuze" by Picatinny Arsenal, Dover, N.J., Apr. 1974. Other setting rings are shown by P. A. Kunz in U.S. Pat. No. 2,270,534 filed Jan. 27, 1939; N. M. Lake in U.S. Pat. No. 2,304,106 filed Dec. 8, 1942; and R. Leroy in U.S. Pat. No. 2,939,394 filed Jan. 26, 1956.

SUMMARY OF THE INVENTION

An object of this invention is to provide a mechanical stop for precluding the rotation of a setting ring beyond predetermined limits of a plurality of turns in the clockwise and counter-clockwise directions. The setting ring is adapted to drive the tape of a tape reader in the range setting mechanism of an electronic fuze for ordnance.

BRIEF DESCRIPTION OF THE DRAWING

These and other objects, features and advantages of the invention will be apparent from the following specification thereof taken in conjunction with the accompanying drawing in which.

DESCRIPTION OF THE INVENTION

Figure 1:
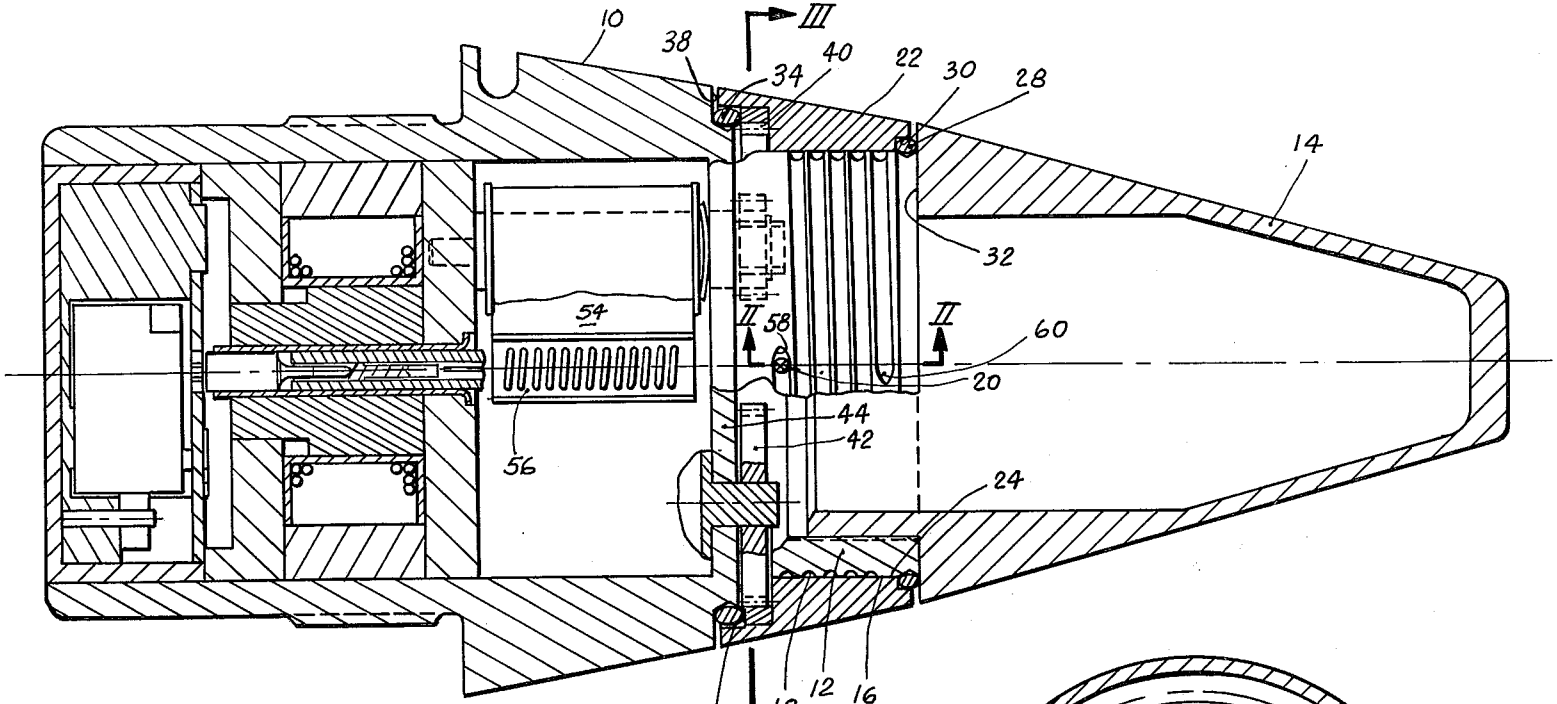
FIG. 1 is a longitudinal cross-section of an electronic fuze for ordnance having a setting ring and stop assembly embodying this invention.
Figure 3:
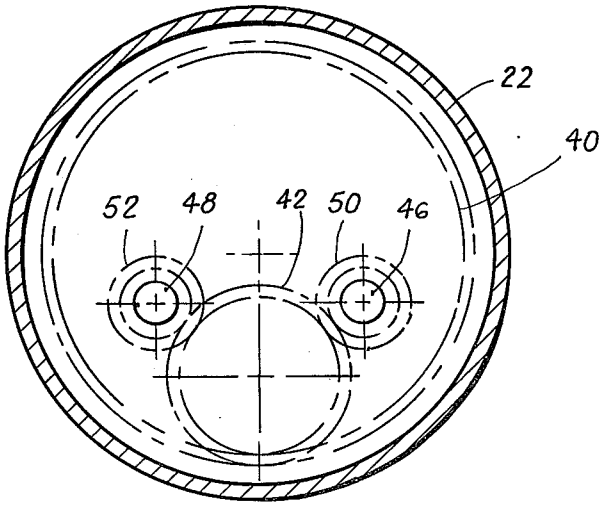
FIG. 3 is a detail of the assembly of the fuze of FIG. 1 taken along the plane III—III.
Figure 2:
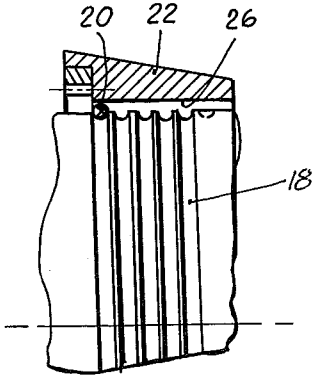
FIG. 2 is a detail of the assembly of the fuze of FIG. 1 taken along the plane II—II.

An electronic fuze for ordnance is shown in FIG. 1. The fuze includes a main body 10 which has a neck portion 12 into which is threaded a nose body 14. The outer cylindrical surface 16 of the neck portion 12 has a helical raceway 18 of a plurality of turns of semi-circular longitudinal cross-section which receives less than the total cross-section of a ball 20. A setting ring 22 is journaled for rotation on the surface 16 and has an inner cylindrical surface 24 which has a longitudinally extending raceway 26 of semi-circular transverse cross-section which also receives less than the total cross-section of the ball 20. A forward O-ring seal 28 is provided between a shoulder 30 on the setting ring and a transverse face 32 on the nose body. An aft O-ring seal 34 is provided between a shoulder 36 on the setting ring and a shoulder 38 on the main body. The setting ring has an internal ring gear 40 which is meshed with an intermediate gear 42 which is journaled for rotation on transverse plate portion 44 of the main body 10. Two spools 46 and 48 are also journaled on the plate portion 44 and respectively have gears 50 and 52 directly in mesh with the intermediate gear 42. This rotation of the setting ring directly drives the two spools in opposite directions. A tape 54 is wound to and between the spools over a read out assembly 56. A spring differential may be provided between one gear and its spool to accommodate the change in diameter of the spool as the tape winds thereon. The read out assembly may be of the type shown in my concurrently filed application Ser. No. 769,757, filed Feb. 17, 1977.

The ball 20 concurrently rides in the longitudinal raceway 26 and the helical raceway 18. The disposition of the ball in the clockwise end 58 of the helical raceway precludes further clockwise rotation of the setting ring, but does permit counter-clockwise rotation. Similarly, the disposition of the ball in the counter-clockwise end 60 of the helical raceway precludes further counter-clockwise rotation of the setting ring, but does permit clockwise rotation. In between these predetermined end points, the setting ring is free to rotate through the plurality of the turns of the helical raceway. The winding of the tape is thus coextensive with the rotation of the setting ring, and overwinding of the tape beyond its predetermined limits is precluded.

It will be appreciated that the invention can be used to advantage wherever a multi-turn stop assembly is required in environments other than the electronic fuze for ordnance herein disclosed as exemplar.

What is claimed is:

1. A multi-turn setting ring assembly comprising:

a body having a cylindrical outer surface portion;

a setting ring having a cylindrical inner surface portion journaled for rotation on said cylindrical outer surface portion of said body;

a ball;

a multi-turn helical raceway, having a longitudinal cross-section adapted to receive less than the total cross-section of said ball, formed into one of said surface portions, and having respective obturations of its cross-section at the clockwise and counter-clockwise ends thereof;

a longitudinally extending raceway, having a transverse cross-section adapted to receive less than the total cross-section of said ball, formed into the other of said surface portions;

said ball concurrently being disposed in part in each of said raceways; and having a mode of operation such that said ring is free to rotate on said body in the clockwise direction until said ball abuts said clockwise obturation, and is free to rotate on said body in the counter-clockwise direction until said ball abuts said counter-clockwise obturation.

2. An assembly according to claim 1 wherein:

said helical raceway is formed on said cylindrical outer surface portion of said body, and said longitudinal raceway is formed on said cylindrical inner surface of said setting ring.

3. An assembly according to claim 1 further including:

driven means;

driving means substantially fixed to said setting ring and coupled to said driven means; and having a mode of operation such that rotation of said setting ring in one direction causes said driving means to drive said driven means in a first direction, and rotation of said setting ring in the other direction causes said driving means to drive said driven means in a second direction.

4. An assembly according to claim 3 wherein:

said driven means is a tape wound between a first and a second roller; and said driving means includes a first gear substantially fixed to said setting ring, a second gear coupled to and driving said first roller, a third gear coupled to and driving said second roller;

and a fourth gear coupling said first gear to said second and third gears.

* * * * *